US005825279A

United States Patent [19]

Yagi

[11] Patent Number: 5,825,279

[45] Date of Patent: Oct. 20, 1998

[54] SLIDE POTENTIOMETER

[75] Inventor: Yoshikazu Yagi, Tsuyama, Japan

[73] Assignee: Matsushita Electric Industrial Co., Ltd., Japan

[21] Appl. No.: 653,271

[22] Filed: May 24, 1996

[30] Foreign Application Priority Data

May 26, 1995 [JP] Japan ..... 7-127854

[51] Int. Cl.[6] ..... H01C 10/38

[52] U.S. Cl. ..... 338/176; 338/160; 338/118

[58] Field of Search ..... 338/176–183, 338/74, 118, 133, 160, 161, 194

[56] References Cited

U.S. PATENT DOCUMENTS

| | | | |
|---|---|---|---|
| 3,365,691 | 1/1968 | Hillman | 338/183 |
| 3,693,129 | 9/1972 | Shimizu | 338/183 |
| 3,746,923 | 7/1973 | Spira et al. | 315/291 |
| 3,883,840 | 5/1975 | Dornen et al. | 338/128 |
| 3,996,550 | 12/1976 | Yano et al. | 338/183 |
| 4,047,146 | 9/1977 | Takeyama | 338/176 |
| 4,060,789 | 11/1977 | Achtmann et al. . | |
| 4,101,864 | 7/1978 | Van Benthuysen . | |
| 4,172,248 | 10/1979 | Okuya | 338/176 |
| 4,274,074 | 6/1981 | Sakamoto | 338/160 |
| 4,369,424 | 1/1983 | Miyamoto | 338/161 |
| 4,583,032 | 4/1986 | Nunziata et al. . | |
| 4,947,054 | 8/1990 | Flowers et al. . | |
| 4,975,677 | 12/1990 | Tamura | 338/158 |

FOREIGN PATENT DOCUMENTS

| | | | |
|---|---|---|---|
| 1-101604 | 4/1989 | Japan | 338/74 |
| 1450629 | 9/1976 | United Kingdom . | |

*Primary Examiner*—Michael L. Gellner
*Assistant Examiner*—Karl Easthom
*Attorney, Agent, or Firm*—Rossi Associates

[57] ABSTRACT

A rail 30, having a long groove 31 on an upper surface thereof, is disposed in a space between an upper surface of cover 28 having an elongated hole 29 and an insulating substrate 21. With this arrangement, water or the like, entering from the upper part of cover 28, falls directly or via a groove 27*a* formed on an upper surface of a slider 25 and is settled or accumulated in long groove 31 of rail 30. Excellent dust-protective and waterproofing effects are obtained. Furthermore, these entering substances are drained via long groove 31 of rail 30, preventing them from spraying out to uncertain places.

5 Claims, 4 Drawing Sheets

SLIDE POTENTIOMETER

BACKGROUND OF THE INVENTION

1. Field of the Invention

This invention generally relates to a slide potentiometer preferably used for acoustic instruments or devices which have severe requirements in their dust-protective and waterproofing abilities.

2. Prior Art

Among numerous acoustic devices, mixing consoles are specially sensitive, when used for professionals, to ashes of cigarette, wetting by juice, coffee or the like during their operations. Slide potentiometers, used in these mixing consoles, are therefore primarily required to adopt an arrangement capable of preventing their resistance and conductive paths from being subjected to these dust and water. A conventional slide potentiometer, responsive to this kind of needs, will be explained with reference to the accompanying drawings.

FIG. 5 is an exploded perspective view showing such a conventional slide potentiometer, and FIG. 6 is a cross-sectional view of the conventional slide potentiometer shown in FIG. 5. In FIGS. 5 and 6, reference numeral 1 represents an insulating substrate on which a resistance path 2 and a conductive path 3 are formed. Reference numeral 4 represents external terminals connected to resistance path 2 and conductive path 3. Reference numeral 5 represents a slider having a side surface supporting a brush 6 thereon and an upper surface mounting a projecting lever 7 thereon. Brush 6 slides on both of resistance path 2 and conductive path 3.

Reference numerals 8 and 9 represent parallel rails along which slider 5 can slide in a predetermined sliding direction. Reference numeral 10 represents a cover having an upper surface 10*b* and side surfaces 10*c* opposed at the both ends of the sliding direction. An elongated recess 10*a* is formed on the upper surface 10*b* of cover 10 for guiding lever 7 in the sliding direction. Parallel rails 8 and 9 are fixedly supported by the side surfaces 10*c* of cover 10. Thus, slider 5 is housed in cover 10. Reference numeral 11 represents a lid closing the side opening of cover 10 which is opposed to the insulating substrate 1 installed on the other side surface of cover 10.

An operation of the conventional slide potentiometer having the arrangement described above will be explained hereinafter.

Dust and water, possibly entering through an elongated lever guide hole formed on a set panel, are settled or accumulated in a recess 10*a* of the slide potentiometer which is elongated in the sliding direction for guiding lever 7. Dust and water, then, flow or fall down to the bottom passing through a side space opposed to the insulating substrate 1, as indicated by arrows in FIG. 6. This arrangement protects insulating substrate 1 from being contaminated by dust and water.

However, the above-described conventional arrangement requires two rails 8 and 9 to support slider 5, and further requires a two-piece cover construction consisting of cover 10 and lid 11. Hence, downsizing is difficult and the cost is expensive.

Furthermore, it was impossible to identify how and where the entering substances, especially water, fell and settled in the set after passing through the slide potentiometer. Hence, there was a problem that collecting thus entering water and performing maintenance was difficult for many of users.

SUMMARY OF THE INVENTION

Accordingly, in view of above-described problems encountered in the prior art, a principal object of the present invention is to provide a slide potentiometer which is compact in size, cheap in cost, comparable with or superior to the conventional products in the dust-protective and waterproofing abilities, and further capable of facilitating the maintenance at the set side.

In order to accomplish this and other related objects, the present invention provides a slide potentiometer comprising: an insulating substrate on which a resistance path and a conductive path are formed, the resistance path and the conductive path being respectively connected to external terminals; a rail having a groove on an upper surface thereof so as to extend in a longitudinal direction thereof, the rail being disposed above the insulating substrate; a slider, having a lower surface supporting a brush thereon and an upper surface mounting a projecting lever thereon, disposed in such a manner that the slider is slidable along the rail while the brush is brought into contact with the resistance path and the conductive path formed on the insulating substrate; and a cover for accommodating the rail and the slider therein, having an upper surface formed with an elongated hole into which the lever provided on the slider is inserted and having a lower end connected to the insulating substrate.

According to features of preferred embodiments of the present invention, both ends of the rail protrude from end surfaces of the cover in a sliding direction of the slider.

With this arrangement, dust and water entering from the upper part of the slide potentiometer are surely collected by the groove formed on the rail which is positioned beneath the upper part of the slide potentiometer and extending in the sliding direction so as to form the recessed cross section. Hence, dust and water cannot reach the insulating substrate positioned under the rail. Furthermore, the slide potentiometer is disposed at a slightly inclined angle when installed in the set. Hence, entering water and the like can be drained through the groove of the rail to a predetermined place out of the cover. Thus, maintenance or aftercare can be simplified.

BRIEF DESCRIPTION OF THE DRAWINGS

The above and other objects, features and advantages of the present invention will become more apparent from the following detailed description which is to be read in conjunction with the accompanying drawings, in which.

DETAILED DESCRIPTION OF THE PREFERRED EMBODIMENT

Figure 1:
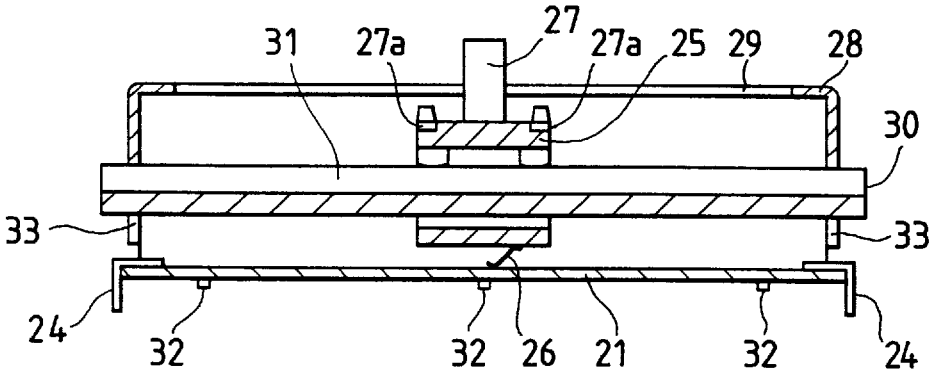
FIG. 1 is a cross-sectional view showing a slide potentiometer in accordance with a preferred embodiment of the present invention.

A preferred embodiment of the present invention will be explained in greater detail hereinafter, with reference to the accompanying drawings. Identical parts are denoted by an identical reference numeral throughout views.

Figure 3:
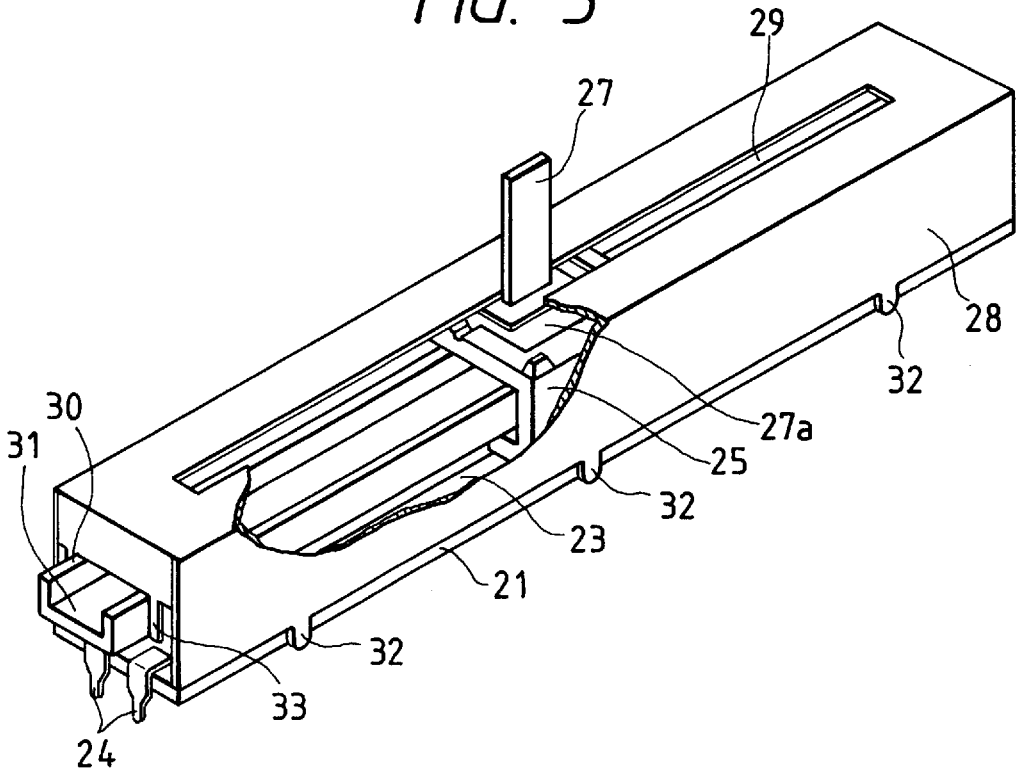
FIG. 3 is a partly sectional perspective view showing the slide potentiometer in accordance with the preferred embodiment of the present invention.
Figure 2:
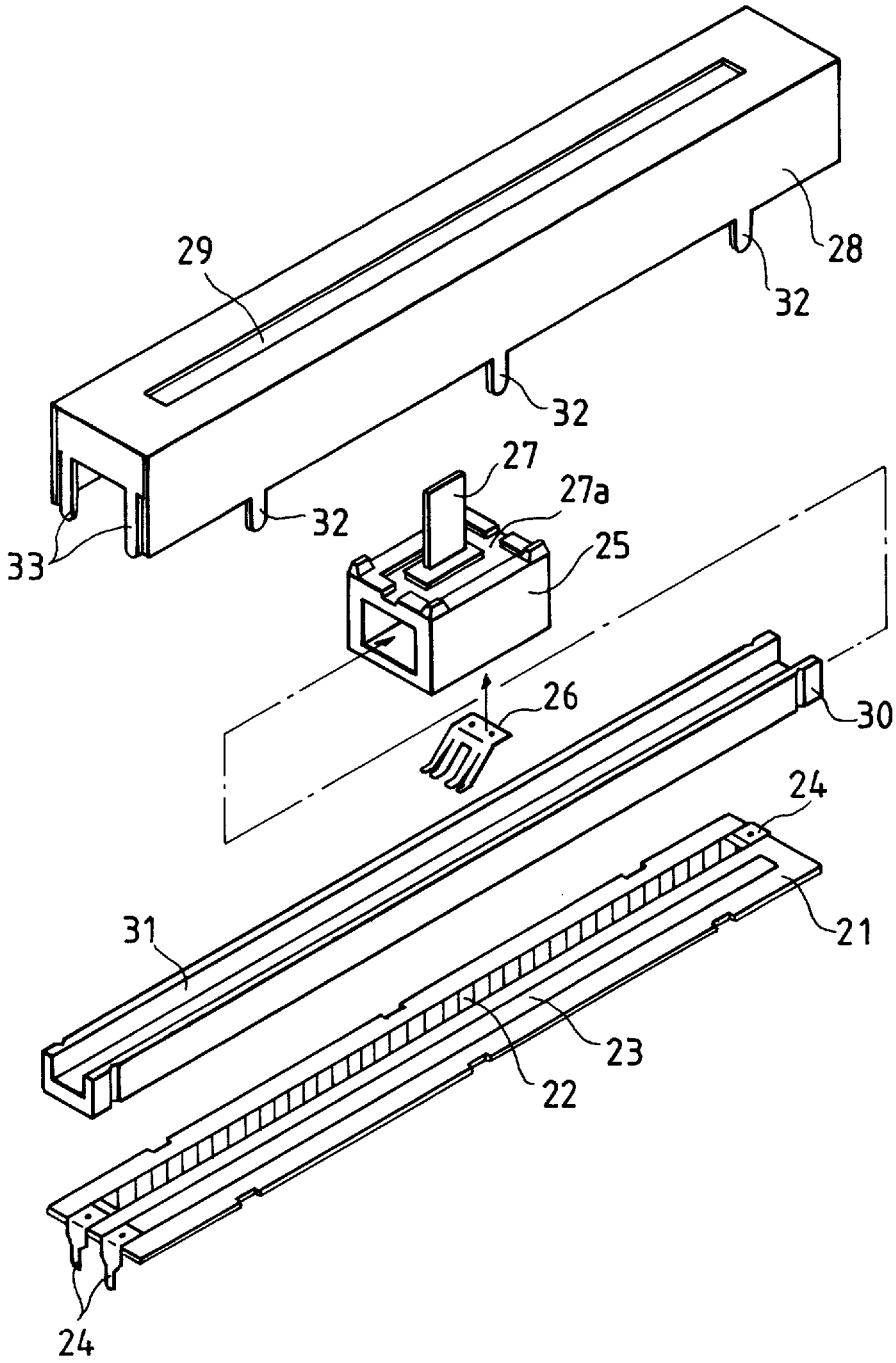
FIG. 2 is an exploded perspective view showing the slide potentiometer in accordance with the preferred embodiment of the present invention.
Figure 4:
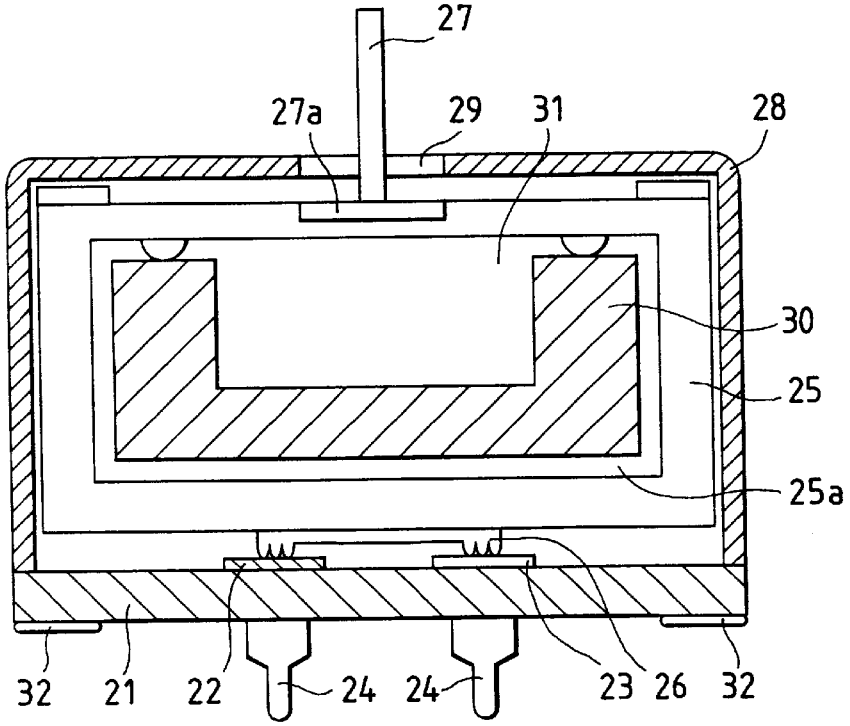
FIG. 4 is a cross-sectional view showing the slide potentiometer in accordance with the preferred embodiment of the present invention, seen in a cross section normal to the sliding direction.
Figure 5:
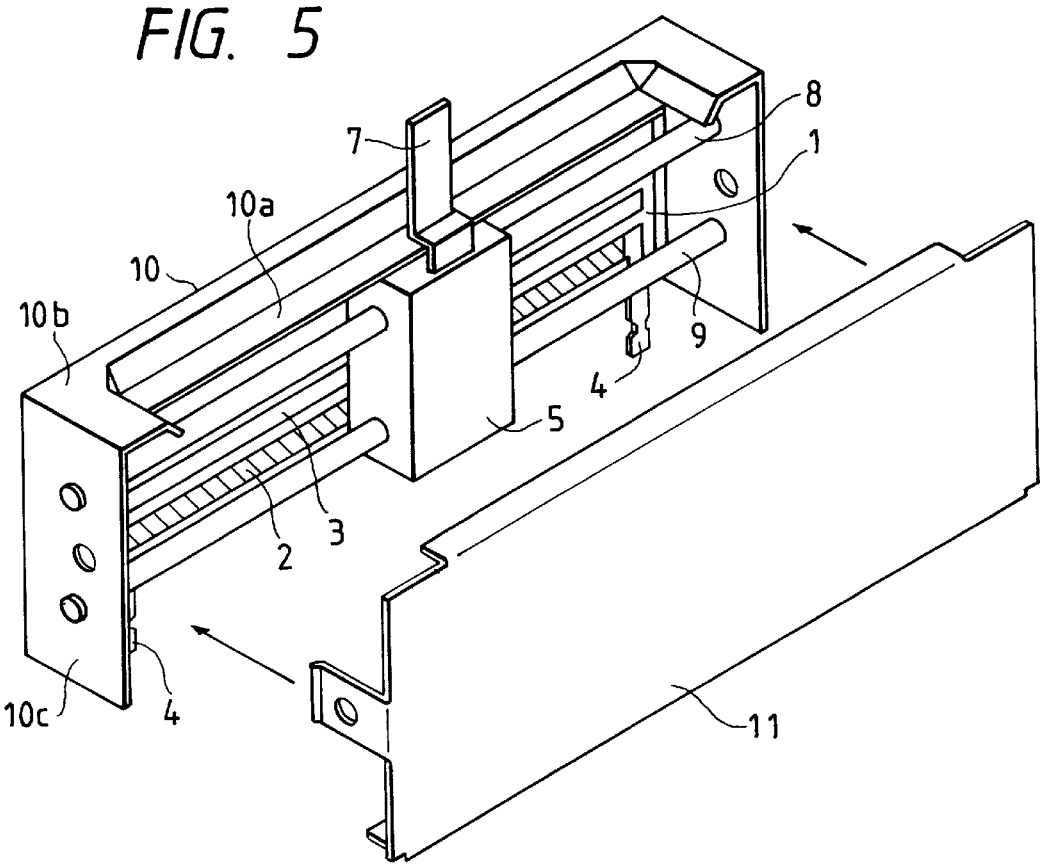
FIG. 5 is an exploded perspective view showing a conventional slide potentiometer.
Figure 6:
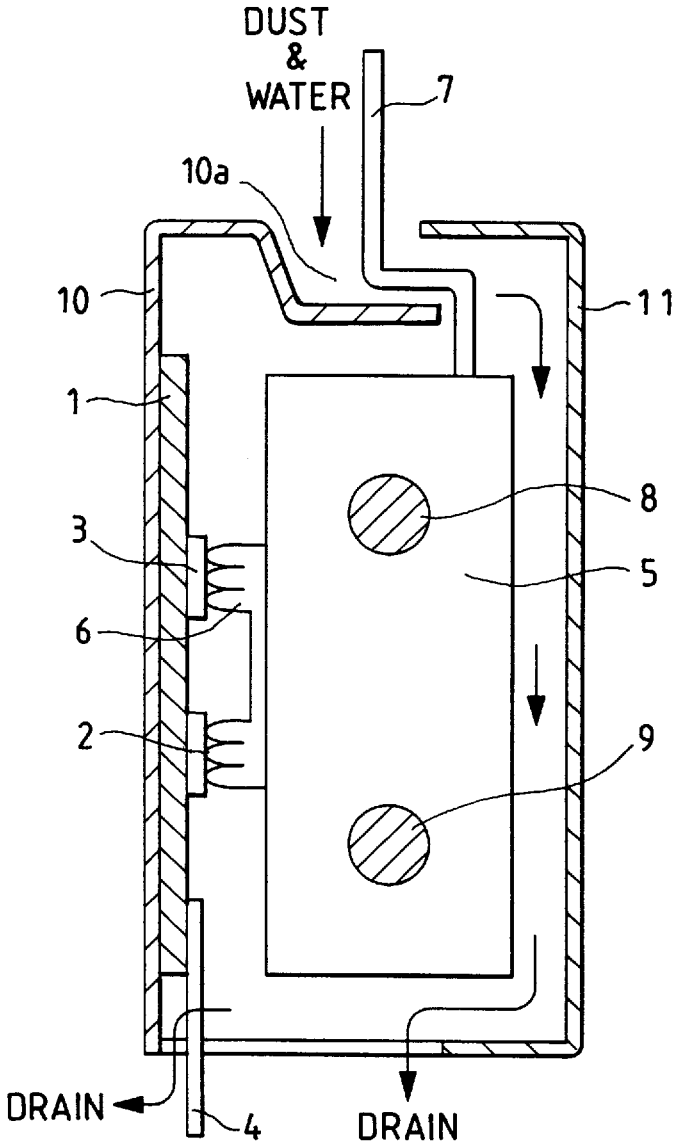
FIG. 6 is a cross-sectional view of the conventional slide potentiometer shown in FIG. 5.

FIG. 1 shows a cross-sectional view of a slide potentiometer in accordance with a preferred embodiment of the present invention. FIG. 2 is an exploded perspective view showing the slide potentiometer shown in FIG. 1. FIG. 3 is a partly sectional perspective view showing the slide potentiometer of FIG. 1. FIG. 4 is a cross-sectional view showing the slide potentiometer of FIG. 1, seen in a cross section normal to the sliding direction.

In FIGS. 1 through 4, reference numeral 21 represents an insulating substrate on a flush upper surface of which a resistance path 22 and a conductive path 23 are formed. Reference numeral 24 represents external terminals connected to longitudinal ends of resistance path 22 and conductive path 23. Reference numeral 25 represents a slider having a lower surface supporting a brush 26 sliding on both the resistance path 22 and conductive path 23 and an upper surface mounting a projecting lever 27. Grooves 27*a* are formed at both sides of lever 27 on the upper surface of slider 25. Slider 25 has a rectangular through hole 25*a* formed at a center thereof so as to extend in the longitudinal axis.

Reference numeral 28 represents a metallic cover having an elongated hole 29 on an upper surface thereof. Elongated hole 29 guides lever 27 of slider 25. Reference numeral 30 represents a rail slidably supporting slider 25 thereon. Rail 30 is formed into a rectangular shape having a recessed cross section to form a groove 31 at the center of the upper surface thereof. Rail 30 is inserted in the rectangular through hole 25*a* of slider 25.

Groove 31 is positioned just beneath the elongated hole 29 of cover 28, and extends in the sliding direction of slider 25. The width of groove 31 is sufficiently wider than that of elongated hole 29 of cover 28.

Reference numeral 32 represents installation legs provided in the periphery of an opening opened at the bottom of cover 28. Cover 28 is fixed to insulating substrate 21 by bending these insulation legs 32. Reference numeral 33 represents another legs provided at longitudinally opposed side surfaces of cover 28. These legs 33 are used for fixing longitudinal ends of rail 30.

An operation of the slide potentiometer of the present invention having the arrangement described above will be explained hereinafter.

Dust and water, possibly entering through an elongated lever guide hole formed on a set panel, further enter into an inside space of cover 28 through elongated hole 29 guiding lever 27 of slider 25. However, these entering substances fall directly, or via grooves 27*a* on the upper surface of slider 25, into the long groove 31 of rail 30 located under the elongated hole 29 of cover 28 and are settled or accumulated there. Hence, dust and water cannot reach the insulating substrate 21 positioned under rail 30. Furthermore, the slide potentiometer of the present invention is disposed at a slightly inclined angle when installed in the set. Hence, entering water and the like can be drained through the longitudinally extending groove 31 of rail 30 to a predetermined place out of cover 28. Hence, maintenance or aftercare can be simplified.

Furthermore, the above-described effects of the present invention can be further enhanced by arranging both ends of rail 30 so as to protrude from the end surfaces of cover 28 in the longitudinal direction, as shown in FIGS. 1 and 3.

As explained above, the present invention disposes the rail having the groove extending in the sliding direction on the upper surface thereof in the space between the upper surface of the cover having the elongated lever guide hole and the insulating substrate on which the resistance path and the conductive path are formed. The rail is fixed to the cover in such a manner that both ends of the rail protrude from side surfaces of the cover. Grooves are formed on the upper surface of the slider. The arrangement of the present invention can realize downsizing and cost reduction in accordance with the reduction of the number of parts. Thus, it becomes possible to provide an excellent slide potentiometer having dust-protective and waterproofing abilities comparable with or superior to the conventional products, and easy to perform maintenance at the set side. Practical effects brought by the present invention are fairly marvelous.

As this invention may be embodied in several forms without departing from the spirit of essential characteristics thereof, the present embodiment as described is therefore intended to be only illustrative and not restrictive, since the scope of the invention is defined by the appended claims rather than by the description preceding them, and all changes that fall within metes and bounds of the claims, or equivalents of such metes and bounds, are therefore intended to be embraced by the claims.

What is claimed is:

1. A slide potentiometer comprising:

an insulating substrate on which a resistance path and a conductive path are formed, said resistance path and said conductive path being respectively connected to external terminals;

a rail including an upper surface having a substantially straight groove, that extends in a longitudinal direction thereof, wherein said rail is spaced above said insulting substrate to provide a clearance between a lower surface of the rail and the insulating substrate;

a slider including a lower surface, a brush provided on the lower surface, an upper surface, and a projecting lever provided on the upper surface, wherein said slider is slidably disposed on said rail such that said brush, located below said rail on the lower surface of said slider, is forcibly brought into contact with said resistance path and said conductive path formed on said insulating substrate; and a cover including an internal space for accommodating said slider and at least a portion of said rail therein, an upper surface formed with an elongated hole into which said lever provided on said slider is slidably inserted and a lower end connected to said insulating substrate, wherein said elongated hole has a width narrower than a width of said elongated groove of said rail and is disposed directly above said elongated groove of said rail;

wherein said slider includes a through hole that extends along a longitudinal axis of the slider and said rail is disposed in said through hole.

2. The slide potentiometer in accordance with claim 1, wherein an upper portion of said slide is slidably supported by said upper surface of said rail and a lower portion of said slide is located in said clearance provided between said lower surface of said rail and said insulating substrate, such that said lower portion of said slide is spaced apart from the lower surface of said rail.

3. The slide potentiometer in accordance with claim 1, wherein said cover includes end surfaces, and said rail includes end portions that protrude from said end surfaces of said cover in a sliding direction of said slider.

4. The slide potentiometer in accordance with claim 1, wherein a lateral width of said rail is wider than a lateral width of said brush.

5. The slide potentiometer in accordance with claim 1, wherein a lateral width of said rail is wider than a lateral width of said brush so that said rail overhangs said brush.

* * * * *